US005427655A

United States Patent [19]

Woebcke et al.

[11] Patent Number: 5,427,655

[45] Date of Patent: Jun. 27, 1995

[54] HIGH CAPACITY RAPID QUENCH BOILER

[75] Inventors: Herman N. Woebcke, Barnstable, Mass.; Victor Andruszewski, London, United Kingdom

[73] Assignee: Stone & Webster Engineering Corp., Boston, Mass.

[21] Appl. No.: 153,885

[22] Filed: Nov. 17, 1993

Related U.S. Application Data

[60] Continuation-in-part of Ser. No. 19,790, Feb. 19, 1993, abandoned, which is a division of Ser. No. 902,913, Jun. 24, 1992, Pat. No. 5,271,827, which is a division of Ser. No. 619,740, Nov. 29, 1990, Pat. No. 5,147,511.

[51] Int. Cl.[6] ..... F28D 7/10

[52] U.S. Cl. ..... 196/138; 165/141; 165/169; 122/6 R

[58] Field of Search ..... 196/138, 98; 122/6 R, 122/7 R, 235.12; 165/141, 142, 169

[56] References Cited

U.S. PATENT DOCUMENTS

| | | | |
|---|---|---|---|
| 3,392,211 | 7/1968 | Buschmann et al. | 260/683 |
| 3,403,722 | 10/1968 | Woebcke | 165/1 |
| 3,888,213 | 6/1975 | Akturk et al. | 122/478 |
| 3,910,347 | 10/1975 | Woebcke | 165/142 |
| 4,170,964 | 10/1979 | Jehn et al. | 122/235 |
| 4,331,105 | 5/1982 | Kawamura et al. | 122/406 |
| 4,351,275 | 9/1982 | Bhojwani et al. | 122/7 |
| 4,356,151 | 10/1982 | Woebcke et al. | 422/145 |
| 4,453,496 | 6/1984 | Yoshinari | 122/6 |
| 4,526,759 | 7/1985 | Stewart | 422/143 |
| 4,563,194 | 6/1986 | Simon | 48/77 |
| 4,593,652 | 6/1986 | Ehrlich | 122/4 |
| 4,770,128 | 9/1988 | McDonald et al. | 122/6 A |
| 5,186,815 | 2/1993 | Lenglet | 208/48 |

FOREIGN PATENT DOCUMENTS

| | | | |
|---|---|---|---|
| 1091174 | 11/1967 | United Kingdom | C07C 3/30 |
| 1095727 | 12/1967 | United Kingdom | C08F 3/30 |

*Primary Examiner*—W. Gary Jones
*Assistant Examiner*—Steven P. Griffin
*Attorney, Agent, or Firm*—Hedman, Gibson & Costigan

[57] ABSTRACT

A quench boiler apparatus and process is disclosed wherein the hot effluent gases are indirectly cooled by contact with a central internal cold side, one or more internal bayonets and one or more waterwall tubes.

13 Claims, 6 Drawing Sheets

HIGH CAPACITY RAPID QUENCH BOILER

CROSS REFERENCE TO RELATED APPLICATIONS

The present application is a continuation-in-part application of Ser. No. 08/019,790, filed Feb. 19, 1993, now abandoned, which in turn is a divisional application of Ser. No. 07/902,913, filed Jun. 24, 1992, now U.S. Pat. No. 5,271,828, which in turn is a divisional of Ser. No. 07/619,740, filed Nov. 29, 1990, now U.S. Pat. No. 5,147,511.

FIELD OF THE INVENTION

The present invention relates generally to an apparatus and a process for cooling a fluid and, in particular to an apparatus and process for rapidly cooling a fluid. The apparatus and process of the present invention are especially suitable for rapidly quenching and recovering heat from a furnace effluent issuing from a hydrocarbon cracking furnace.

BACKGROUND OF THE PRESENT INVENTION

The present invention comprises an apparatus and process which are used to rapidly cool hot fluids. The apparatus comprises a means whereby a hot fluid is contacted on cooling surfaces to provide a rapid decrease in the temperature of the hot fluid. The cooling means is suitable for use with cooling fluids at elevated pressures. Further, the apparatus and process of the present invention rapidly cools hot gases without substantial pressure change in the process stream.

The cooling means has particular and advantageous application when used in conjunction with a process for the production of olefins by cracking hydrocarbon feeds, such as light naphthas at high temperature and short residence time, using a high radiant heat furnace having relatively short conduits of small diameter. The cooling means provides a rapid reduction in the effluent product gas temperature from the furnace without also incurring a substantial pressure drop.

Cracking furnace effluent gas temperatures are very high and at these high temperatures the cracking reactions proceed at a rapid rate. In order to substantially stop the reactions in the effluent gas to reduce the production of undesirable by-products, especially coke precursors such as pyrolysis fuel oil, it is beneficial to rapidly cool the effluent gas after it leaves the reactor to a temperature at which the reactions substantially cease. There are several conventional relatively high capacity means available for doing this, most of which have one or more drawbacks. Most commonly, the conventional means of cooling comprises shell and tube heat exchangers employing tube sheets which invariably result in substantial pressure loss of the effluent gas. This type of heat exchanger employs a tube sheet having multiple tubes at the inlet head which causes the formation of eddies and back-mixing. See FIG. 3.

The eddies are detrimental to the production of olefins for two main reasons. Firstly, the eddies increase the pressure lost at the inlet head, thereby raising the pressure at the reactor coil outlet and thus reducing the yield of olefins. Secondly, the eddies constitute volumes of backmixing with higher than average residence times. At the temperatures present in the inlet head to the cooling zone of the quench boiler, even small increases in residence time, i.e., as low as about 5 milliseconds, result in significant overcracking of the feed to tar and coke, and concomitantly in reactor shutdown for decoking operations.

Mention is also made herein of Woebcke, U.S. Pat. No. 3,910,347, which teaches a relatively low capacity quench boiler essentially tubular in shape and provided with a divergent inlet section having an angle of divergence of less than 10°. While this device has met with considerable success in the industry to date, increasing demands of product selectivity, lower quality feedstocks and increased capacity requirements, have resulted in the need for improved relatively high capacity quench boilers which are also effective in heat recovery.

The cooling techniques and apparati of the present invention are particularly useful in the high capacity cooling of the effluent gases from a process for the thermal cracking of hydrocarbons. In the thermal cracking of hydrocarbons, in the process described hereinafter, the hydrocarbon feed can be heated to high temperature, maintained at high temperature for a short residence time and selectively converted to desired products. In accordance with the present invention, the hot gas reaction products are rapidly quenched or cooled in such a manner that the conversion is substantially stopped after the desired residence time. Still further, the apparatus of the present invention can be employed in further reducing the temperature of the reactor effluent to within about 100° F. of the coolant medium, thereby providing an excellent means of heat recovery and steam generation.

Although the quenching apparatus and process of cooling of the present invention are particularly suitable for use in cooling the hot gas effluent issuing from a pyrolysis furnace, the concept can readily be applied to other processes for cooling hot product streams, for heat recovery and/or for heating fluids. The cooling means and process can be used for rapidly cooling hot gaseous products from other cracking processes. The quenching apparatus provides indirect cooling on surfaces. The apparatus is simple in design and easy to operate. The apparatus can be of any size and is normally designed for a specific processing facility. The apparatus can be vertical or horizontal. The cooling unit rapidly cools hot fluids while not substantially changing the pressure of the fluid. That is, the pressure of the cooled fluid at the outlet of the cooling is substantially the same as the inlet pressure. The material to be cooled can be upflow or downflow.

SUMMARY OF THE PRESENT INVENTION

It is an object of the present invention to provide an improved process and apparatus having increased capacity for the cooling of fluids.

It is also an object of the present invention to provide an improved process and apparatus for the quenching of a pyrolysis effluent from an ethylene furnace.

It is a further object of the present invention to provide a quench boiler having significant increased heat exchange surface area per foot of length in indirect contact with the fluid to be cooled.

It is a still further object of the present invention to provide a quench boiler having improved waterwall tube design.

It is another object of the present invention to provide a high capacity quench boiler which is further useful as a heat recovery means.

It is still another object of the present invention to provide a process having improved selectivity to ethylene in the steam cracking of hydrocarbons.

It is still another further object of the present invention to decrease the loss in pressure of the reactor effluent through the quench boiler.

The apparatus of the present invention comprises an indirect heat exchanger, optionally having a venturi at or before the inlet that converts velocity to a pressure head. The hot side of the heat exchanger is contacted with at least three cooling means, comprising at least one internal cold side cooling means located centrally in the apparatus, at least one internal bayonet tube cooling means placed directly within the hot side conduit, and at least one external waterwall tube cooling means located outside of the hot side.

DETAILED DESCRIPTION OF THE PRESENT INVENTION

The high capacity rapid quench boiler of the present invention will be described as part of a system for thermally cracking hydrocarbons to produce olefins, although the heat exchanger may be employed in a wide variety of other applications. In its simplest form, the quench boiler of the present invention is a high capacity indirect heat exchanger having a passage for the flow of effluent therethrough in indirect contact with cooling means. The high capacity quench boiler of the present invention is capable of effectively rapidly quenching and cooling reactor effluents flow rates of greater than about 5000 pounds per hour, preferably greater than about 10000 pounds per hour, more preferably greater than about 25000 pounds per hour, to about 50000 pounds per hour.

The cooling apparatus can use any desired cooling fluid. The cooling fluid can be a liquid that, on heating, partially or completely vaporizes. The preferred cooling fluids are liquids. Especially preferred is water.

Where the cooling fluid is water, the cooling apparatus can be used to produce high temperature, high pressure steam. The heat energy recovered in cooling can be used for power generation or heating service.

Figure 1:
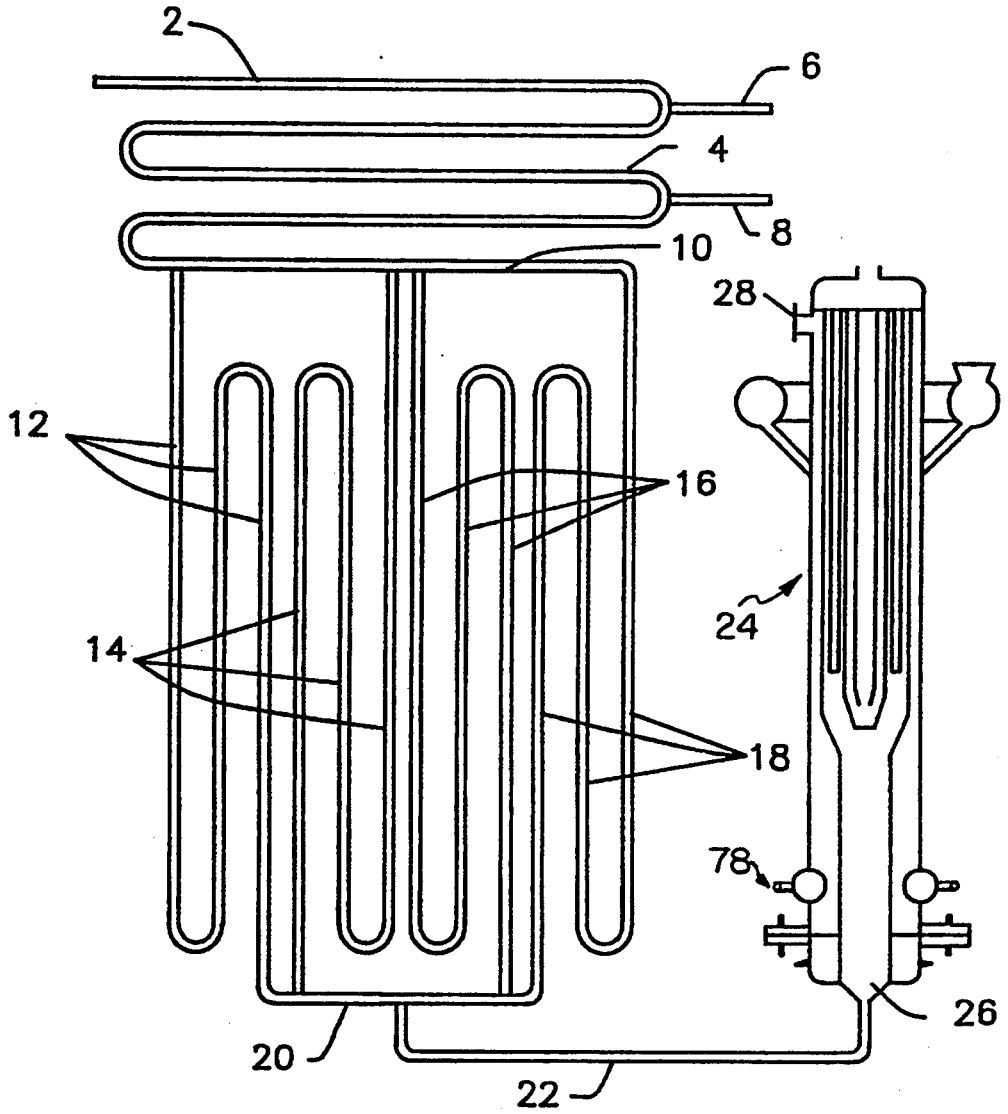
FIG. 1 depicts in schematic form a process embodiment of the present invention.

A typical reactor furnace and cooling unit is shown in FIG. 1. A petroleum naphtha fraction boiling in the range of 90° to 375° F. is fed through a line 2 into a convection preheat section 4 wherein it is heated from about ambient temperature to a temperature of about 1000° to 1100° F. Steam, at a ratio of steam to hydrocarbon of about 0.4 to 0.8 by weight, is introduced into the preheat section 4 through lines 6 and/or 8 at a point where the naphtha feed is approximately 80% vaporized. The preheated hydrocarbon and steam mixture at about 1000° to 1100° F. is then fed to a manifold 10 and subsequently into the inlets of coils 12, 14, 16 and 18.

The feed is heated in the coils from about 1000° to 1100° F. to a coil outlet temperature up to about 1650° F. Under the recited conditions the hydrocarbon partial pressure at the coil outlet is about 12 to 14 psia. The residence time of the fluid in the radiant section of the furnace is preferably below 0.20 seconds.

The mass velocity of the hydrocarbon and steam in the coils is about 18 to 26 pounds per second, per square foot of cross-sectional area of the coil. The radiant coil inlet pressure is about 45 psia and the coil outlet pressure of the effluent gases is about 25 psia. The hot effluent gases are fed from the outlet manifold 20 through a line 22 to the quench boiler 24 at a gas velocity of about 800 ft/sec.

The hot gases are introduced into the quench boiler 24 through inlet 26 at a temperature to about 1650° F. The cooled gases are withdrawn from the quench boiler 24 through an outlet 28. The gases are quenched rapidly in about 10–20 milli-seconds to a temperature of about 1200° to 1400° F. and may be conveniently further cooled to temperatures within 100° F. of the coolant, i.e., about 600° F. In this manner, the apparatus of the present invention further functions as a heat recovery means and is capable of producing high pressure steam, such as at about 1500 psig. The gas pressure at the outlet 22 is typically about 25 psia.

Thus, the quench boiler 24 of the present invention can be adapted both to rapidly quench the furnace effluent by 100° to 600° F., that is, from about 1500° to 1650° F. down to about 1000° to 1400° F. and to further cool the effluent down to desired processing temperatures, typically below about 700° F.

The quenching step is carried out very rapidly after the effluent leaves the radiant section of the furnace, i.e., in about 1 to 30 milliseconds, preferably in about 5 to 20 milliseconds. The rapid quenching step is critical in the high temperature, short residence time process for cracking hydrocarbons to produce olefins. It is found that if the cooling step takes substantially more than about 30 milliseconds, there may be substantial coke deposits in interior passages of the cooling unit and downstream equipment.

When high temperature and short residence times are used to crack hydrocarbon to form olefins, it is preferred to rapidly quench the furnace effluent sufficiently below the reaction temperature to substantially stop the reaction. If this is not done, the reaction continues after the effluent has left the reaction zone and can result in degradation of product, reduction of olefin yield, and increased production of polynuclear aromatics and/or compounds of low volatility. Such products tend to cause deposition of coke on the walls of the downstream equipment resulting in shutdown of the equipment for decoking. At 1600° F. reaction rates are so high that the residence time in a quench zone at times as short as 10 milliseconds results in a significant amount of reaction taking place. It is therefore, important to quench the effluent rapidly after it leaves the furnace to a temperature at which substantially no deleterious reaction takes place, e.g., below 1100° to 1400° F.

Figure 3:
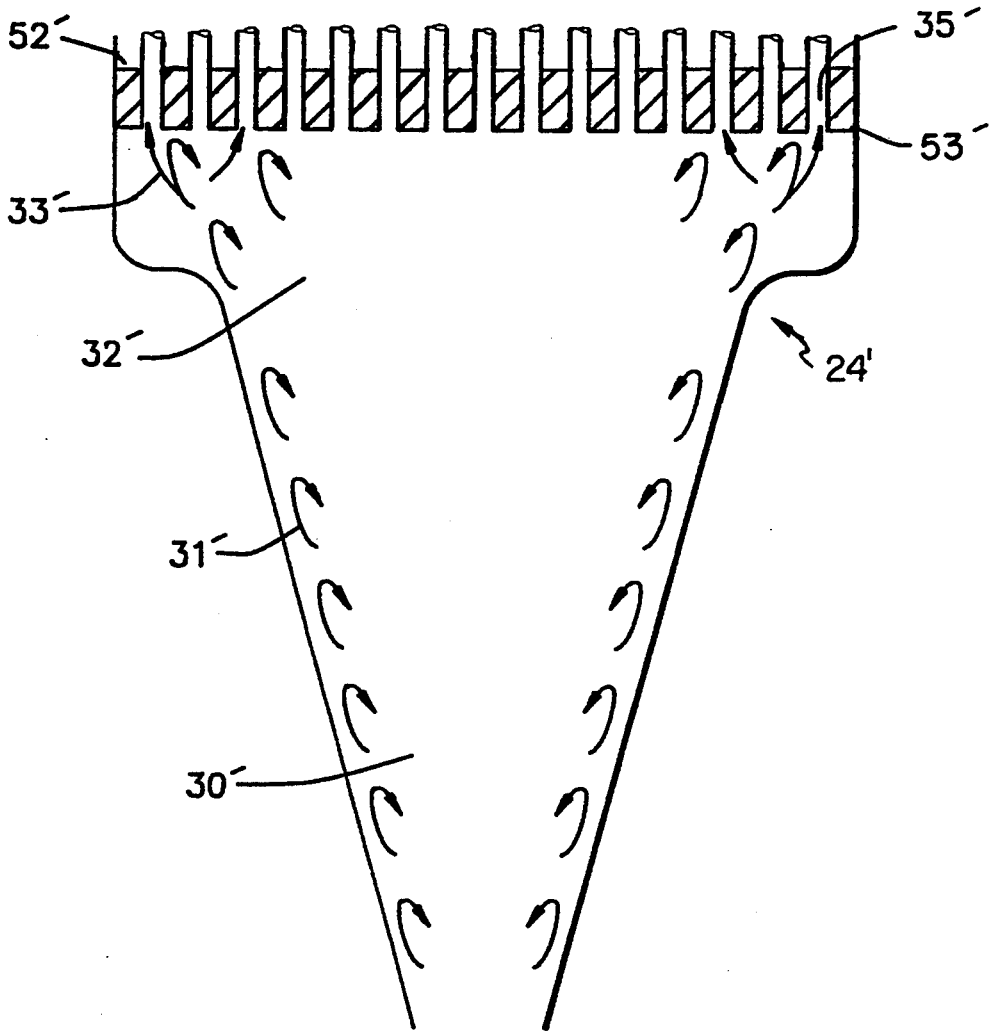
FIG. 3 (PRIOR ART)
FIG. 3 illustrates the inlet section to a conventional tube sheet high capacity quench boiler.

Another contributing factor to the residence time at high temperatures in the quench boiler is the flow of the effluent gas through the quench boiler inlet head. In the high capacity tube sheet quench boilers of the prior art, as seen in FIG. 3, the gaseous effluent issuing from the reactor is directed through inlet 30' to inlet head 32' prior to entry into tubes 35' of the cooling zone wherein the effluent is cooled by indirect contact with cooling tubes 52'.

It has been found by the present inventors that as a result of the construction of the conventional quench boilers 24' to maintain stream line flow through the tubes 35', the average cracked gas velocity at the tube sheet 53' is about one-fourth of that in the tubes 35'. Consequently, eddies 31' and 33' form along the enclosing wall of inlet 30' and in the inlet head 32', respectively. These eddies, or areas of high turbulence and backmixing, contribute to localized increased residence time in the inlet, which at the high temperatures present in the inlet cause increased coking and lower ethylene yields in very short times.

Figure 4:
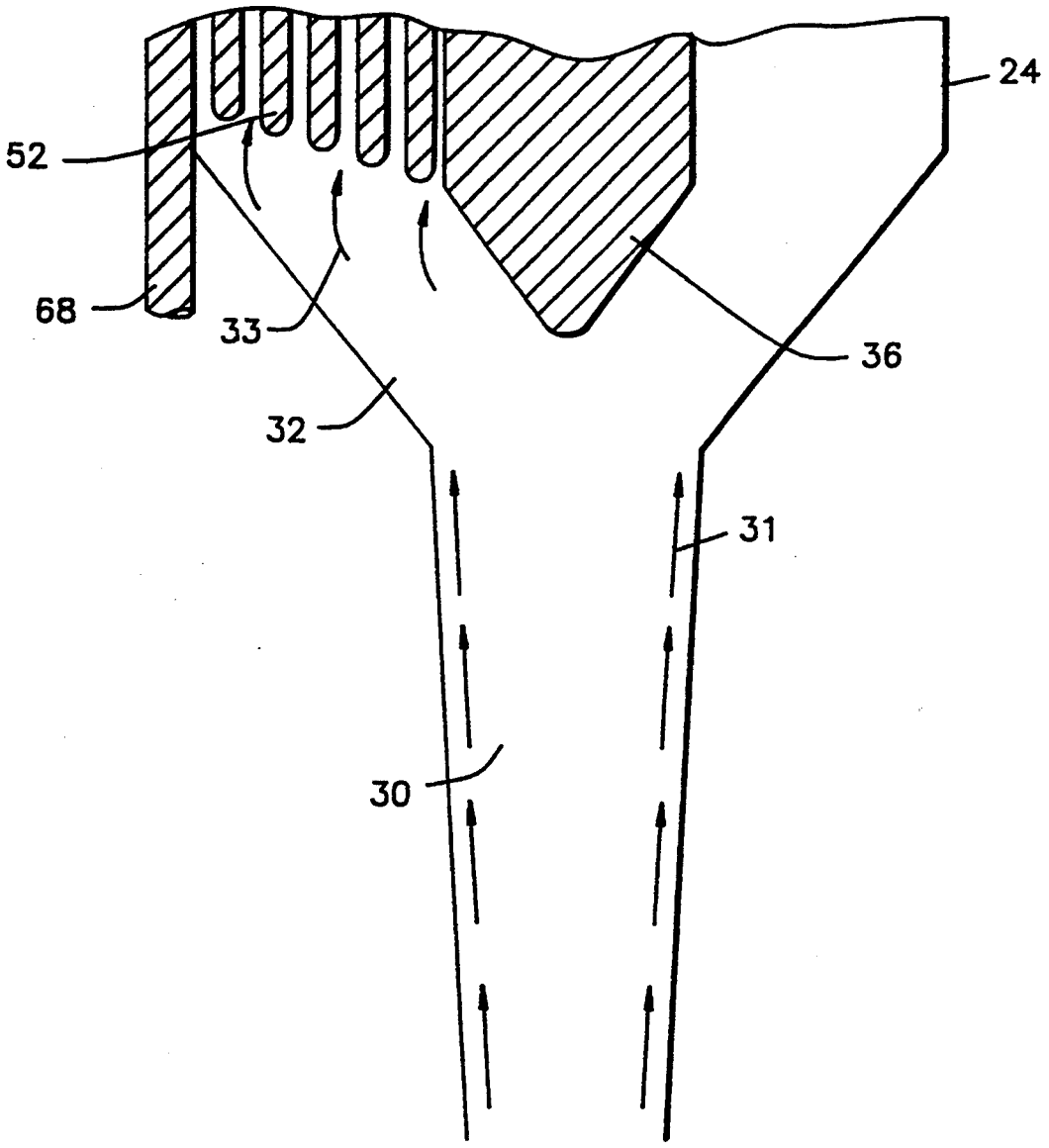
FIG. 4 illustrates the inlet section to the quench boiler of the present invention.

Surprisingly, the present inventors have found that the entry configuration as shown in FIG. 4, substantially eliminates or significantly reduces the formation of eddies. Referring to FIG. 4, the hot gaseous effluent issuing from the reactor is fed to the quench boiler 24 through a conical venturi 30 which serves to convert velocity to pressure. The hot gas is then directed toward the cooling surfaces in at least one annular venturi 32 where the velocity is further reduced to the velocity of the gas through the cooling zone. The annular venturi is preferably constructed with dimensions such that the decrease in velocity per unit length is substantially the same as that in the conical venturi 30.

The hot cracked gas then enters the cooling zone wherein the length of the cooling tubes and spacing between the tubes may be adjusted to maintain the gas at substantially the same velocity as in the annular venturi 32. In this manner, non-turbulent flow 31 and 33 is maintained in the conical venturi 30, the annular venturi 32 and cooling zone, thus decreasing the formation of coke and improving the ethylene selectivity.

The quench boiler 24 of the present invention further has a novel construction which provides high cooling surface contact area to effect improved cooling on the hot effluent gas. Unlike the prior art quench boilers, the novel construction of the quench boiler of the present invention enables the unit to combine the functions of rapid quenching and heat recovery operations. In prior art olefin plants designed for ethylene production, cooling of the hot cracked gas was carried out in two disparate steps. The hot cracked gas from the reactor furnace was first quenched to about 1000°-1200° F. to terminate reaction in more than one low capacity quench boiler, typically having capacities less than 10% of the pyrolysis furnace. The outlets from the low capacity quench boilers were then combined and directed to a single high capacity heat recovery boiler and cooled to within 100° F. of the coolant.

Figure 2:
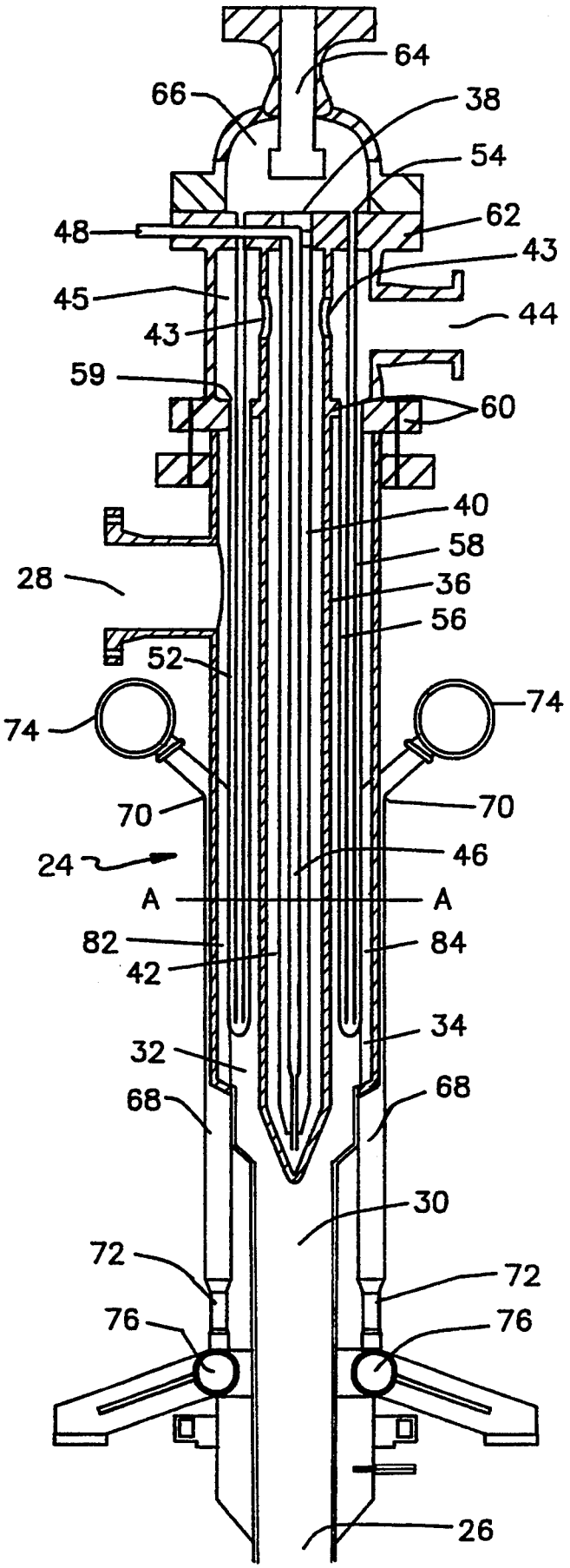
FIG. 2 illustrates a quench boiler useful in the practice of the present invention.

Referring to FIG. 2, the quench boiler 24 has a hot gaseous effluent inlet 26 which is connected to a conical venturi tube 30. The conical venturi tube 30 serves to reduce the hot product gas velocity, such as from about 800 to about 250 ft/second. The hot gaseous effluent then flows for cooling into two or more annular venturi 32 and 34 at an angle ranging from about 4° to about 7°.

Figure 5:
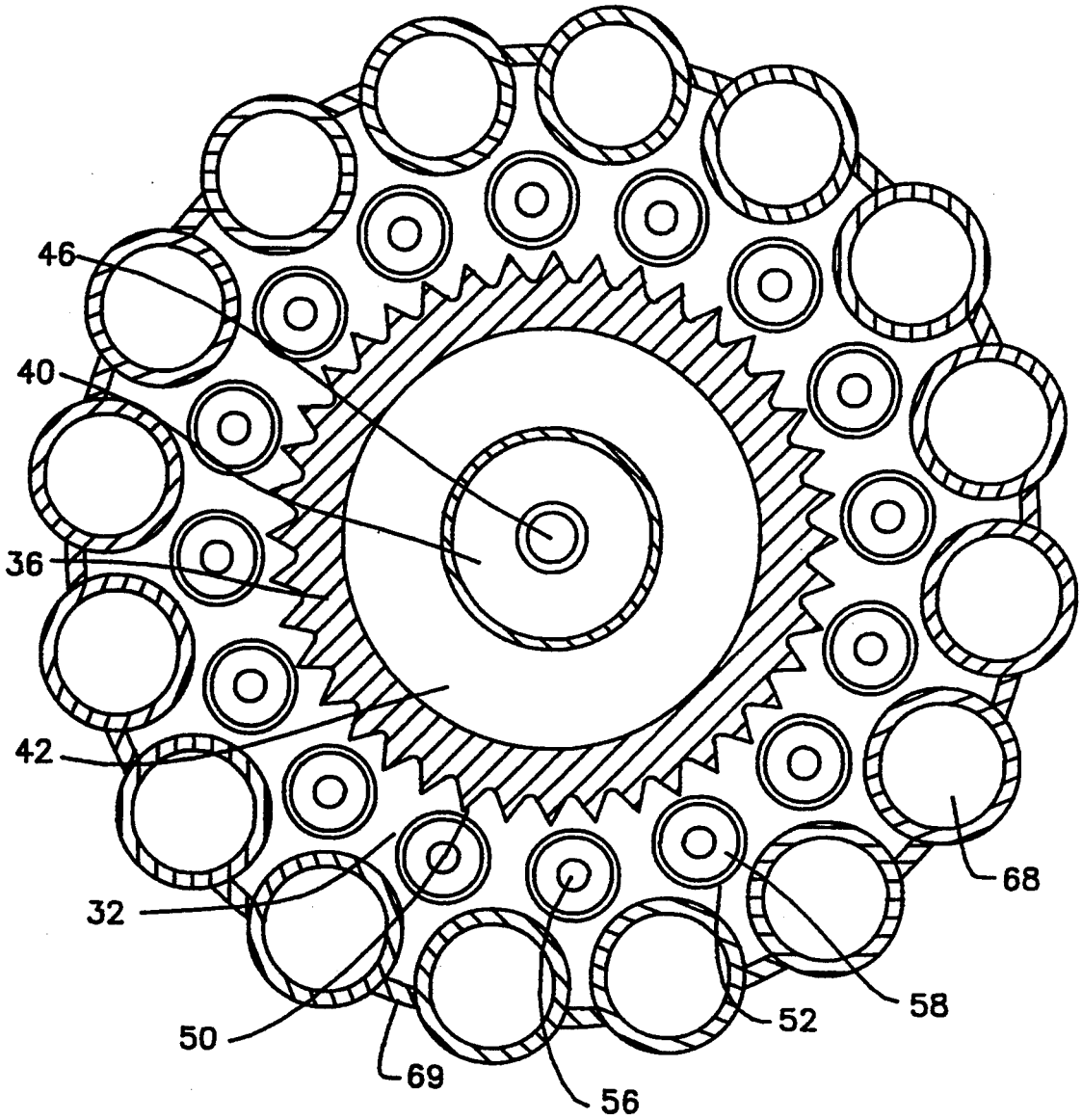
FIG. 5 represents a cross-sectional horizontal view taken along line A—A of the quench boiler of FIG. 2.

The quench boiler 24 of the present invention provides three separate means of cooling. The first means of cooling is an internal cold side 36 located centrally in the quench boiler 24. The internal cold side 36 comprises a boiler feed water inlet 38, a downcomer 40, an inner cold chamber 42 and a steam outlet 44. Optionally, the internal cold side 36 may also comprise a blowdown 46 discharging through a conduit 48. In a preferred embodiment, internal cold side 36 may comprise fins or studs or the like 50, as best seen in FIG. 5, to increase heat transfer contact area.

The second means of cooling comprises internal bayonet tubes 52. The internal bayonet tubes 52 are preferably annular in construction, comprising an inlet 54, a downcomer 56, an annular cold side 58 and a steam outlet 44.

While the bayonet tubes 52 may be placed in the hot streams 82 and 84 in any number and/or pattern, typically the bayonet tubes 52 are arranged concentrically inside each of the hot streams 82 and 84. More than one concentric circle of bayonet tubes may be employed if desired.

In a preferred embodiment, the bayonet tube annular cold sides 58 are welded to the lower tube sheet 60, while the bayonet tube center downcomers 56 are welded to the upper tube sheet 62. The internal cold side center pipe 36 is welded to both the lower tube sheet 60 and the upper tube sheet 62. Welding the center pipe 36 to both the upper tube sheet 62 and the lower tube sheet 60 at the cold end of the quench boiler unexpectedly enables one to reduce the thickness of both tube sheets while maintaining close center to center spacing of the bayonet tubes 52. The close center to center spacing of the bayonet tubes 52 further improves the heat transfer rates between the hot process stream and the bayonet tubes.

Referring again to FIG. 3, in prior art tube sheet construction the tube sheets 53' are supported at the inlet head 32' where the support is subject to the forces of the high pressure coolant at the elevated temperatures of the hot end of the quench boiler. Such a configuration requires greater spacing between the cooling tubes 52', on the order of about 0.8 to 1.2 inches. Conversely, in the present quench boiler design with the bayonet tube supports located at the cold end of the quench boiler, significantly closer spacing of the bayonet tubes may be effected, i.e., on the order of from about 0.15 to about 0.4 inches, more preferably, from about 0.15 to about 0.2 inches. Still further, the close spacing of the bayonet tubes, enables the use of shorter tubes to effect the same degree of cooling as the prior art tube sheets.

Returning to FIG. 2, water is supplied to the internal cold side 36 inlet 38 and internal bayonet 52 inlet 54 by means of a centrally located pipe 64 in communication with a reservoir 66 located at the top of the quench boiler 24.

Figure 6:
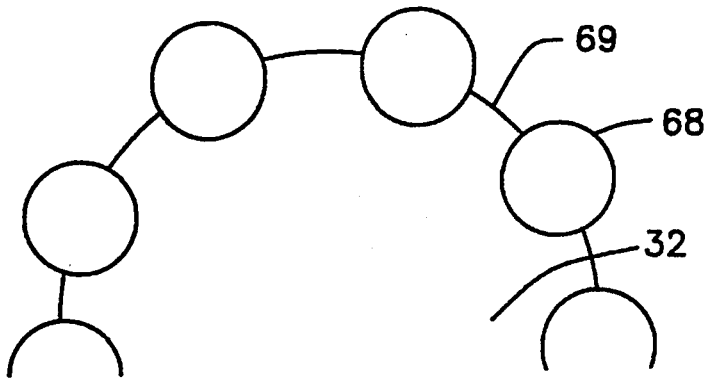
FIGS. 6 and 6A illustrate the water wall tube construction of a quench boiler of the present invention and of the prior art, respectively.
Figure 6A:
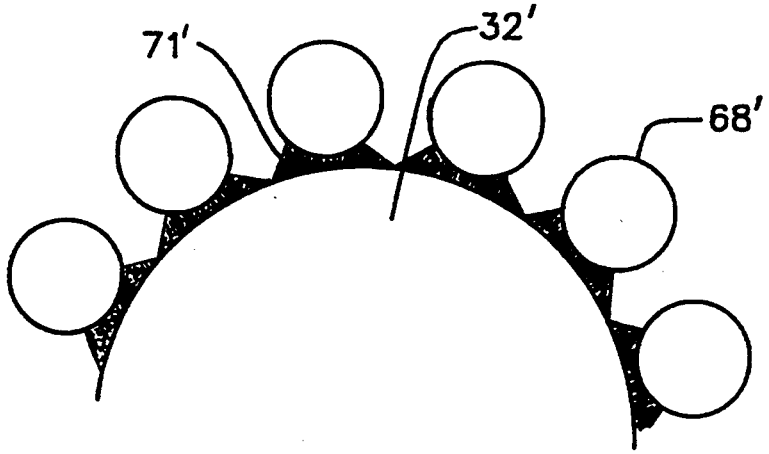
FIG. 6A (PRIOR ART)

The third cooling means comprises at least one waterwall tube 68. Typically, there are present a number of waterwall tubes 68 equally spaced and welded into the outer wall of the quench boiler 24. As best seen in FIG. 6, the water wall tubes 68 form the outer shell of the quench boiler and are connected by spacers 69. The prior art teachings regarding waterwall tube construction as seen in FIG. 6A, see U.S. Pat. No. 3,910,347, employed water wall tubes 68' which were welded by welding material 71' to the surface of the shell of the quench boiler. Unexpectedly, the construction of the present invention not only provides increased cooling surface area, i.e., twice the cooling surface per unit length of the shell, but also provides improved heat transfer by eliminating welding material 71' between the water wall tube 68 and the quench boiler shell. The weld material offers resistance to heat transfer which is eliminated in the present invention.

Referring to FIG. 5, spacers 69 are provided to connect the waterwall tubes 68 together and act as an additional cooling surface cooled by the waterwall tubes 68. Returning to FIG. 2, these waterwall tubes 68 run the approximate length of the wall and, at the upper and lower ends, connecting portions 70 and 72 respectively, are in communication with torus 74 at their upper end and torus 76 at their lower end. Torus 76 has a connecting conduit 78 through which coolant fluid passes into torus 76 and flows upwardly through the waterwall tubes 68 and out of upper torus 74. See also FIG. 1.

The quench boiler 24 can be designed and sized to accommodate any desired cooling service. Suitable apparati for use in the present invention can have an overall length of the cooling apparatus from coolant inlet 64 to hot gas effluent inlet 26 of from about 15 to about 30 feet.

Hot gases in an inlet 26 at a velocity of from about 700 to about 800 ft/second enter the quench boiler 26 where they are slowed in conical venturi 30 to from about 200 to about 300 ft/second and pass first into hot gas annular venturi conduits 32 and 34 for further slowing and then into hot conduits 82 and 84, respectively, where they are cooled and pass out of the apparatus through outlet 28. The coolant water is introduced through inlet 64 and enters reservoir 66 where a first portion is passed to the internal cold side 36 via inlets 38. The coolant water flows downwardly through a centrally located downcomer 46 of concentric cold pipe 36 and a mixture of steam and water flows upwardly in annular passage 42 and passes through openings 43 to reservoir 45 and outlet 44. Cold pipe 36 provides indirect cooling for the hot furnace effluent at the inner wall surface of conduits 82 and 84.

A second portion of the coolant water in reservoir 66 is passed to bayonet tubes 52 via inlets 54. The coolant water flows downwardly through centrally located downcomers 56 of concentric bayonets 52 and a mixture of steam and water flows upwardly in annular passage 58 and passes through openings 59 to reservoir 45 and outlet 44. Bayonets 52 provide indirect cooling for the hot furnace effluent inside conduits 82 and 84.

Simultaneously, coolant water from a line 78 enters bottom tori 76 and through inlets 72 to waterwall tubes 68. A mixture of steam and water exit the waterwall tubes through bends 70 and into tori 74. The waterwall tubes 68 provide additional indirect cooling for the hot furnace effluent gases at the outer wall surface of conduits 82 and 84.

The quench boiler of the present invention is capable of steam-air decoking by means well known to those of ordinary skill in the art. Further, the quench boiler of the present invention is capable of cooling the process stream to within about 50° to 100° F. using one quench boiler per pyrolysis furnace. The simple construction of the quench boiler of the present invention provides for significantly increased heat exchange surface area in direct contact with the stream to be cooled.

DESCRIPTION OF THE PREFERRED EMBODIMENTS

The following examples illustrate the present invention. They are not to be construed to limit the scope of the appended claims in any manner whatsoever.

EXAMPLES 1–3

A hydrocarbon pyrolysis effluent at a temperature of 1630° F. and a varying flow rate is passed to a quench boiler as shown in FIG. 2 for quenching of the reaction. The process variables for the various streams are set forth below in Table I.

TABLE I

| Example | 1 | 2 | 3 |
|---|---|---|---|
| Process Parameters | | | |
| Reactor effluent | | | |
| temperature, °F. | 1630 | 1630 | 1630 |
| flow rate, lb/hr | 6300 | 26200 | 52400 |
| Coolant[1] | | | |
| pressure, psia | 1500 | 1500 | 1500 |
| temperature in, °F. | 600 | 600 | 600 |
| Quench boiler effluent temperature, °F. | 675 | 675 | 675 |
| Cooling Surfaces | | | |
| Center tube | | | |
| number | 1 | 1 | 1 |
| outer diameter, in | 8 | 31 | 16 |
| Bayonet tubes | | | |
| number | 16 | 40 | 158 |
| outer diameter, in | 1.7 | 1.5 | 1.9 |
| Water wall tubes | | | |
| number | 16 | 40 | 30 |
| outer diameter, in | 2.5 | 2.5 | 3.5 |
| Length, ft | 14 | 18 | 10 |
| Results | | | |
| Heat recovery, mm BTU/hr | 4.2 | 17 | 34 |
| Net pressure recovery, psi[2] | +1.0 | +1.0 | +1.0 |

[1] = boiling water
[2] = friction, velocity heads, less venturi recovery

From the Table above, it can be seen that the quench boiler of the present invention is effective for both high capacity rapid quenching and heat recovery operations with an increase in pressure level of the process stream leaving the exchanger above that entering by about 1 psi.

Many variations of the present invention will suggest themselves to those skilled in the art in light of the above-detailed description. For example, more than one concentric set of internal bayonet tubes may be employed. Further, the quench boiler may be employed to cool a wide variety of hot fluids such as reaction effluents from other cracking reactions. All such obvious modifications are within the full intended scope of the appended claims.

All of the above-referenced patents, patent applications and publications are hereby incorporated by reference.

We claim:

1. A quench boiler having a quench boiler shell housing substantially cylindrical in shape and having a top wall and a bottom; an inlet to said shell housing for introducing a hot fluid at the bottom of said shell housing; a venturi tube located in said shell housing and operatively connected to said hot fluid inlet; at least one hot conduit means for conducting a hot fluid through said shell housing operatively connected to said venturi tube; and an outlet to said shell housing operatively connected to said hot conduit means located near the top of said shell housing; said quench boiler further comprising:

(a) a first cooling means comprising a central inner pipe located centrally within said shell housing and external to and in indirect contact with said hot conduit means;

(b) a second cooling means comprising at least one bayonet tube located internal to and in indirect contact with the fluid in said hot conduit means;

(c) a third cooling means comprising at least one waterwall tube located at the shell housing and external to and in indirect contact with said hot conduit means; and (d) means for supplying a cooling fluid to said first, second and third cooling means; and wherein said hot conduit means comprises two or more annular venturi conduits.

2. A quench boiler as defined in claim 1 wherein said hot conduit means comprises two annular venturi conduits having an angle of divergence from said venturi tube of between about 4° and 7°.

3. A quench boiler as defined in claim 1 wherein the central inner pipe of said first cooling means is an annular pipe comprising an inner downcomer thereby defining a first passage inside said inner downcomer and a second passage between said inner downcomer and said central inner pipe and is located within the hot conduit means.

4. A quench boiler as defined in claim 3 wherein said central inner pipe further comprises a blowdown means located inside said inner downcomer.

5. A quench boiler as defined in claim 3 wherein said second cooling means comprises a plurality of bayonet tubes concentrically spaced within said hot conduit means.

6. A quench boiler as defined in claim 5 wherein said cooling fluid supply means comprises a means for supplying cooling fluid to said first and second cooling means comprising a reservoir at the top of said shell housing defined by the top wall of the shell housing and an upper tube sheet located below said shell housing top wall; and a means for withdrawing cooling fluid from said first and second cooling means comprising a reservoir defined by said upper tube sheet and a lower tube sheet located below said upper tube sheet.

7. A quench boiler as defined in claim 6 wherein the central inner pipe of the first cooling means is welded to both the upper and lower tube sheet and the downcomer of said first cooling means is welded to said upper tube sheet.

8. A quench boiler as defined in claim 7 wherein of the bayonet tubes are welded to said lower tube sheet and the downcomer of each of the bayonet tubes is welded to said upper tube sheet.

9. A quench boiler as defined in claim 6 wherein said cooling fluid supply means comprises a torus for supplying cooling fluid to said third cooling means and a torus for withdrawing cooling fluid from said third cooling means.

10. A quench boiler as defined in claim 3 wherein each of said at least one bayonet tube are annular in construction and comprise an inner downcomer thereby defining a first passage inside said inner downcomer and a second passage between said inner downcomer and said bayonet tube.

11. A process for cooling a hot fluid comprising utilizing the-quench boiler as defined in claim 1.

12. An improved process for improving the selectivity of ethylene from a hydrocarbon feed by cracking said hydrocarbon feed in a pyrolysis furnace at a temperature of from about 1400° F. to about 1650° F. to produce a cracked gaseous effluent, said improvement comprising utilizing the quench boiler as defined in claim 1 to quench said cracked gaseous effluent.

13. A quench boiler having a substantially cylindrical shell housing having a top wall and a bottom, an inlet located at the bottom of said shell housing for introducing a hot fluid, a venturi tube located in said shell housing and operatively connected to said hot fluid inlet, a hot conduit means for conducting the hot fluid through said shell housing operatively connected to said venturi tube, an outlet located near the top of said shell housing operatively connected to said hot conduit means, an upper tube sheet located inside the shell housing below the top wall of the shell housing, and a lower tube sheet located inside the shell housing and below the upper tube sheet; said quench boiler further comprising:

(a) a first cooling means comprising an annular central inner pipe comprising an inner downcomer located centrally within said shell housing and external to and in indirect contact with said hot conduit means wherein the central inner pipe is welded to both said upper tube sheet and said lower tube sheet and the downcomer is welded to said upper tube sheet;

(b) a second cooling means comprising a concentric set of substantially equally spaced bayonet tubes each comprising a downcomer located internal to and in indirect contact with the fluid in said hot conduit means, wherein each of said bayonet tubes is welded to said lower tube sheet and the downcomer is welded to said upper tube sheet;

(c) a third cooling means comprising a set of waterwall tubes located at the shell housing and external to and in indirect contact with said hot conduit means.

(d) a means for supplying cooling fluid to said first and second cooling means comprising a first reservoir defined by the top wall of the shell housing and the upper tube sheet;

(e) a means for withdrawing cooling fluid from said first and second cooling means comprising a second reservoir defined by said upper tube sheet and the lower tube sheet; and (f) a means for supplying and withdrawing cooling fluid from said third cooling means.

* * * * *